United States Patent [19]

Poganitsch

[11] Patent Number: 4,969,266

[45] Date of Patent: Nov. 13, 1990

[54] DRY-SHAVING APPARATUS COMPRISING A SLIDABLE SHUTTER

[75] Inventor: Ernst Poganitsch, Klagenfurt, Austria

[73] Assignee: U.S. Philips Corp., New York, N.Y.

[21] Appl. No.: 184,301

[22] Filed: Apr. 21, 1988

[30] Foreign Application Priority Data

Apr. 24, 1987 [AT] Austria ..... 1028/87

[51] Int. Cl.[5] ..... B26B 19/38

[52] U.S. Cl. ..... 30/34.05; 30/43.92

[58] Field of Search ..... 30/32, 34 R, 43, 43.91, 30/43.92, 90, 34.05

[56] References Cited

U.S. PATENT DOCUMENTS 3,538,604 11/1970 Walter et al. ..... 30/34 R

*Primary Examiner*—Douglas D. Watts

*Attorney, Agent, or Firm*—Ernestine C. Bartlett

[57] ABSTRACT

In a dry-shaving apparatus comprising a slidable shutter (3) for optionally covering or exposing a shear foil (9) of the dry-shaving apparatus, which shear foil is mounted in a shaving-head frame which is detachably secured to a basic apparatus (1) of the dry shaver, said shutter having a first latched position which is locked by a latching means (12, 13, 14, 15) and in which the circuit of the motor for driving the dry-shaving apparatus is closed by the shutter when the shutter exposes the shear foil to allow shaving, the shutter can be slid away from the shear foil completely onto the basic apparatus, the shutter having a further latched position in which it is locked by means of a latch (12, 13, 23, 24) and in which the shear foil and the shaving-head frame are exposed by the shutter and the motor circuit is interrupted by means of the shutter.

8 Claims, 3 Drawing Sheets

DRY-SHAVING APPARATUS COMPRISING A SLIDABLE SHUTTER

BACKGROUND OF THE INVENTION

The invention relates to a dry-shaving apparatus comprising a slidable shutter for optionally covering or exposing a shear foil of the dry-shaving apparatus, by means of which shutter the circuit of the motor for driving the dry-shaving apparatus is closed when said shutter is slid away from the shear foil and exposes said shear foil to allow shaving, said position of the shutter being locked by means of a latch. Such a dry-shaving apparatus is known from DE-OS No. 17 03 196.

SUMMARY OF THE INVENTION

An object of the invention is to construct a dry-shaving apparatus of the type defined in the opening sentence in such a way that it is convenient to operate and so as to preclude incorrect operation. To this end, according to the invention, in a dry-shaving apparatus comprising a shaving-head frame which is detachably secured to a basic apparatus and which carries the shear foil, the shutter can be slid from the shear foil completely onto the basic apparatus, a further position of the shutter being locked by means of a latch, in which further position the shear foil and the shaving-head frame are exposed by the shutter and the motor circuit is interrupted by means of the shutter. Now dry-shaving apparatus comprising a shaving-head frame which is detachably secured to a basic apparatus and which carries the shear foil provide a user with a simple possibility to effect cleaning or to replace the shear foil after removal of the shaving head from the basic apparatus. Such dry-shaving apparatus are generally known per se, for example from DE-OS No. 27 50 795 which corresponds substantially to U.S. Pat. No. 4,184,088. Such a dry-shaving apparatus is now provided by the present invention with a shutter for optionally covering or exposing a shear foil, which shutter can be slid completely onto the basic apparatus from the shear foil, while in addition to the latched position of the shutter, in which position the shear foil is exposed by the shutter to allow shaving and the motor circuit is closed so that the dry-shaving apparatus is ready for shaving (hereafter referred to as the "first latched position"), a further latched position of the shutter is provided, in which further position the shear foil and the shaving-head frame are exposed by the shutter but in which the motor circuit is interrupted by means of the shutter (hereafter referred to as the "further latched position"). In this further latched position of the shutter the shaving-head frame can be removed from the basic apparatus without being impeded by the shutter, to clean the dry-shaving apparatus or to replace the shear foil without the risk of damaging the shutter, the shaving head frame or the shear foil.

Viewed in the direction in which the shutter is slid away from the shear foil, such a further latched position of the shutter can be situated either before or behind the first latched position of the shutter is exposed by the preferably, the further latched position of the shutter, is situated before the first latched position of the shutter. This results in a very simple construction, because only one additional latch for the shutter is required to close the motor circuit by means of the shutter while the shear foil and the shaving-head frame are exposed by the shutter.

It is also found to be advantageous if the shutter is provided with a viewing window through which markings of the two latched shutter positions characterizing said positions and provided on the basic apparatus are visible. Thus, the user can ascertain that the shutter is actually in a desired position.

BRIEF DESCRIPTION OF THE DRAWING

Two embodiments of the invention will now be described in more detail, by way of example, with reference to the accompanying drawings.

DETAILED DESCRIPTION OF THE PREFERRED EMBODIMENTS

Figure 1:
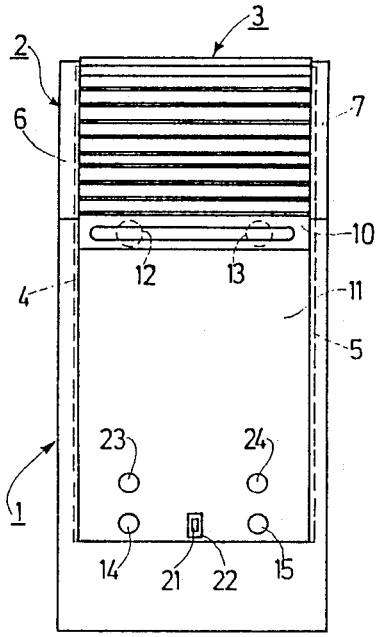
FIG. 1 shows a first embodiment of a dry-shaving apparatus with a shutter covering the shear foil.
Figure 2:
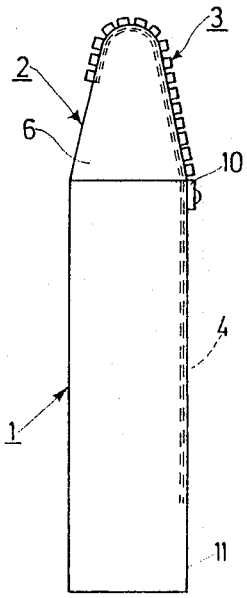
FIG. 2 is a side view of the dry-shaving apparatus of FIG. 1.

FIGS. 1 and 2 show a dry-shaving apparatus comprising a basic apparatus 1 and a shaving-head frame 2 placed on this basic apparatus.

Figure 3:
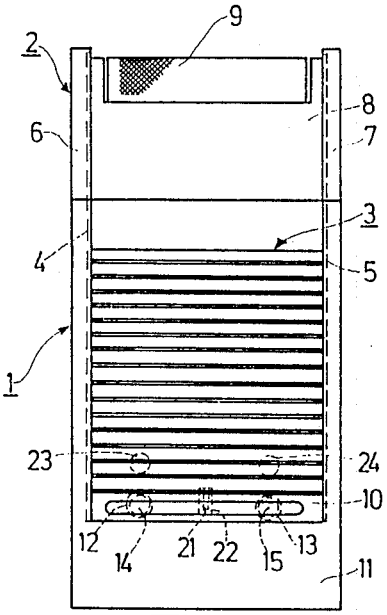
FIG. 3, in the same way as FIG. 1 shows the dry-shaving apparatus of FIG. 1 in the first latched position of the shutter, i.e. in the position whereby the shear foil and the shaving-head frame are exposed by the shutter and the motor circuit is closed by means of the shutter.

In a manner not shown, for example by means of at least one resilient latch the shaving-head frame 2 is detachably secured to the basic apparatus 1. Such a shaving-head frame serves for holding an arcuate shear foil, which in the situation illustrated in FIGS. 1 and 2 is covered completely by a shutter 3 to protect the shear foil when the dry-shaving apparatus is not in use. Such a shutter 3 is arranged on the dry-shaving apparatus so as to be slidable, said shutter being laterally guided at the both sides in groove-shaped guides 4 and 5 in the dry-shaving apparatus, indicated by broken lines in FIGS. 1 and 2. As can be seen, the shutter 3 can be slid from the basic apparatus 1 onto the shaving-head frame 2 and the shear foil, for which purpose the guides 4 and 5 for the shutter 3 in the basic apparatus 1 are continued in the side walls 6 and 7 of the shaving-head frame 2, where they are curved in conformity with the curvature of the shear foil. If the dry-shaving apparatus is to be used, the shutter 3 is slid back onto the basic apparatus 1 from its position shown in FIGS. 1 and 2 until the shear foil is exposed to allow shaving, as is shown in FIG. 3, where it is situated completely on the basic apparatus 1, thus exposing the shaving-head frame whose cross-members 8 retain the shear foil 9. In this first latched position of the shutter, the motor circuit of the motor for the drive of the dry-shaving apparatus is closed by means of the shutter, so that the apparatus is ready for shaving.

In the present embodiment the shutter 3 comprises a gripping element 10 at its end which is remote from the shear foil 9, so that the shutter can be moved simply by hand. This gripping element 10 of the shutter 3 is used both for latching the shutter and for closing the motor circuit. For latching the shutter 3 the gripping element 10 comprises two spaced-apart adjacent spherical recesses 12 and 13, at its side facing the apparatus housing 11, which recesses are adapted to cooperate with balls 14 and 15 which project from the apparatus housing 11. As soon as the shutter 3 has reached the position shown in FIG. 3, the balls 14 and 15 engage in the recesses 12 and 13 and thereby latch the shutter in position.

Figure 5:
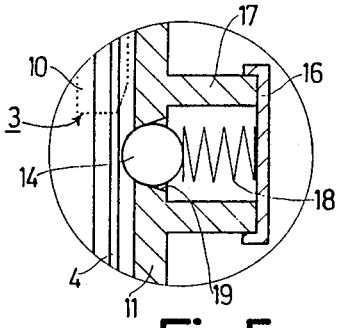
FIG. 5 is a sectional view of a part of a shutter latch constituted by a ball.
Figure 6:
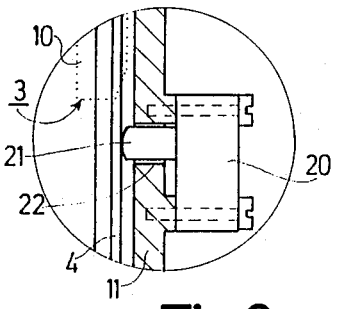
FIG. 6 is a sectional view of a part of a construction for actuating a sensor switch by the shutter.

FIG. 5 shows how one of these balls, for example the ball 14, is mounted on the apparatus housing 11. For this purpose the apparatus housing 11 has a ball cage, which is constituted by a hollow cylindrical projection 17 closed by a cap 16, in which the ball 14 is mounted together with a spring 18, a portion of the ball projecting from an opening 19 in the apparatus housing 11 into the path of the gripping element 10 of the shutter 3. Instead of such ball latches it is obvious that other known latching means may be provided, such as, for example, hook-shaped or fork-shaped latches. At the location of this latch comprising the balls 14 and 15, a sensor switch 20 is arranged in the apparatus housing 11. As is shown in FIG. 6, the switching arm 21 of switch extends so far through an opening 22 in the apparatus housing 11 that it is situated in the path of the gripping element 10 of the shutter 3, enabling said arm to be depressed by the gripping element 10 as soon as the gripping element 10, abuts against said arm when the shutter is slid away from the shear foil, thereby closing the sensor switch 20. This sensor switch 20 is included in the motor circuit of the dry-shaving apparatus, so that the motor circuit is closed by means of the shutter 3 as soon as the shutter is in the position shown in FIG. 3. In this position of the shutter the dry-shaving apparatus is ready for shaving.

Figure 4:
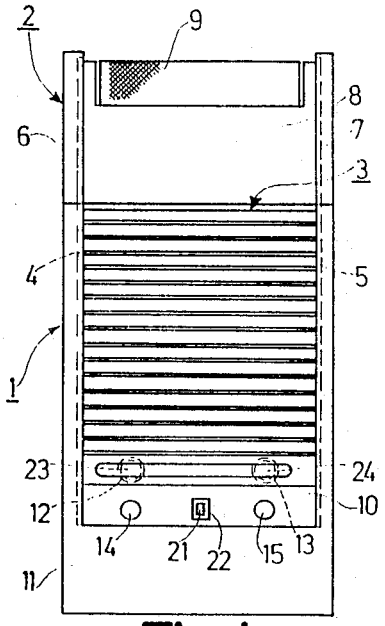
FIG. 4, in the same way as FIG. 1, shows the dry-shaving apparatus of FIG. 1 in the further latched position of the shutter, i.e. in the position whereby the shear foil and the shaving-head frame are exposed by the shutter and the motor circuit is interrupted by means of the shutter, said further latched position of the shutter, viewed in the direction in which the shutter is slid away from the shear foil, being situated before the first latched position of the shutter.

Such a dry-shaving apparatus is also provided with a further latch for the shutter 3, which latch defines a position of the shutter in which said shutter exposes the shear foil and the shaving-head frame but in which the motor circuit is interrupted by means of the shutter referred to herein as the "further latched position" shown in FIG. 4. This further latched position of the shutter 3 is selected in such a way that, viewed in the direction in which the shutter is slid away from the shear foil 9, it is situated before the position of the shutter in which it is latched by the balls 14 and 15 and in which the motor circuit is closed by means of the shutter. This is achieved by means of two further balls 23 and 24 which project from the apparatus housing 11 into the path of the gripping element 10 of the shutter 3 and which engage in recesses 12 and 13 in the gripping element 10 when the shutter is slid away from the shear foil. As can be seen, in such further latched position of the shutter in which it exposes the shear foil and the shaving-head frame, the sensor switch 20 in the motor circuit is not actuated by means of the shutter 3 because the gripping element 10 of the shutter has not yet reached the switching arm 21, so that the motor circuit is interrupted. This is achieved very simply by providing the two further balls 23 and 24. In this further latched position of the shutter, the dry-shaving apparatus is not ready for operation, the shaving-head frame 2 can then be removed from the basic apparatus 1 without being impeded by the shutter 3, for example for the purpose of cleaning or for replacing the shear foil. In this further latched position, damage to shutter, the shaving-head frame or the shear foil is substantially eliminated because the entire shutter 3 is situated on the basic apparatus 1.

If the shutter is moved further away from the shear foil, out of this further latched position position in which it is latched by the first latched balls 23 and 24, it will reach the position in which it is latched by the balls 14 and 15, in which the motor circuit is then closed by means of the shutter 3 and the dry-shaving apparatus is ready for operation, as explained with reference to FIG. 3. As can be seen, the shear foil and the shaving-head frame in the present embodiment are exposed by the shutter in both latched positions of the shutter.

Figure 7:
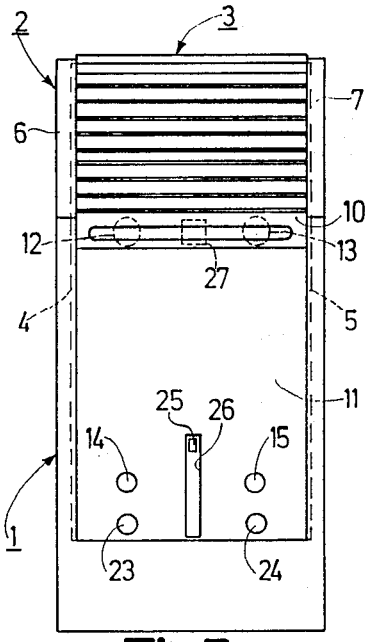
FIG. 7 shows a second embodiment of a dry-shaving apparatus with a shutter covering the shear foil.
Figure 8:
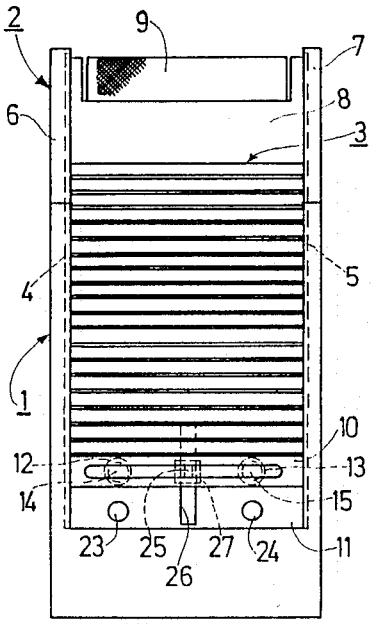
FIG. 8 shows the dry-shaving apparatus of FIG. 7 with the shutter in a first latched position.
Figure 9:
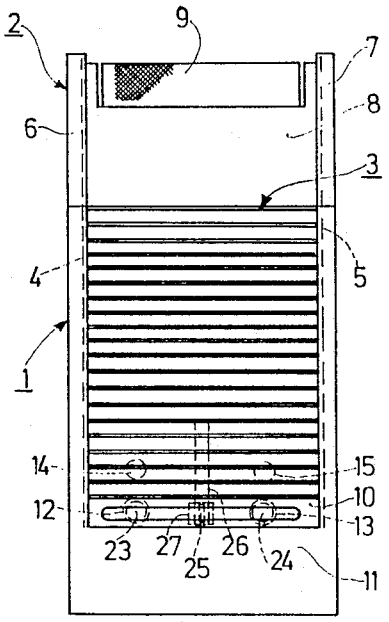
FIG. 9 shows the dry-shaving apparatus of FIG. 7 in a further latched position of the shutter which further latched shutter position, viewed in the direction in which the shutter slid away from the shear foil, is situated behind the first latched shutter position.

In the embodiment shown in FIGS. 7, 8 and 9, the two positions of the shutter 3 are again latched by means of ball latches which cooperate with spherical recesses 12 and 13 in the gripping element 10 of the shutter 3 but, viewed in the direction in which the shutter is slid away from the shear foil, the first latched position of the shutter in which the motor circuit is closed by means of the shutter is now situated before the further latched position of the shutter in which the motor circuit is interrupted by means of the shutter. Accordingly, viewed in the direction in which the shutter is slid away from the shear foil, the balls designated 14 and 15 are situated before the balls designated 23 and 24 if the same designation is chosen as in the embodiment described in the foregoing. Now a slide switch is employed to interrupt and close the motor circuit, which switch, viewed in the sliding direction, has three positions, namely in this order, a first off-position, an on-position and a second off-position. The switching arm 25 of such a slide switch, not shown, then projects from a slot 26 in the apparatus housing 11 into the path of the gripping element 10 of the shutter. The side of the gripping element 10 of the shutter which faces the apparatus housing 11 is formed with a further recess 27 at a location corresponding to said switching arm 25, which recess serves for coupling the gripping element 10 and hence the shutter 3 to the switching arm 25.

If the shutter is slid away from the shear foil out of the position shown in FIG. 7 and the gripping element 10 reaches the switching arm 25, said arm 25 engages in the the recess 27 in the gripping element 10, thereby coupling the shutter to the switching arm 25. As the shutter is moved further away from the shear foil, the switching arm 25 is moved by the shutter until the balls 14 and 15 engage in the recesses 12 and 13 in the gripping element 10 of the shutter to latch the shutter in this position. In this first latched position of the shutter the shear foil 9 is already exposed by the shutter to allow shaving but this is not yet the case with the shaving-head frame 2, as is illustrated in FIG. 8. Since the switching arm 25 is moved by the shutter the slide switch is set from its first off-position to its on position, causing the circuit of the motor for the drive of the dry-shaving apparatus to be closed, so that in this first latched position of the shutter the dry-shaving apparatus is ready for operation, the shear foil 9 being exposed by the shutter to allow shaving. If desired, however, the position in which the shutter is latched by the balls 14 and 15 may be selected in such a way that for a corresponding travel of the shutter the shutter is slid completely onto the basic apparatus to expose the shear foil 9 and the shaving-head frame 2, in the same way as in the embodiment shown in FIGS. 1 to 4.

However, the shutter can now be slid further away from the shear foil out of the position in which it is latched by the balls 14 and 15 until the balls 23 and 24 engage in the recesses 12 and 13 in the gripping element 10 of the shutter 3 to latch the shutter in the further latched position. In this further latched position, the shutter is now situated completely on the basic apparatus 1, so that it exposes both the shear foil 9 and the shaving-head frame 2, as is shown in FIG. 9. During this further sliding movement of the shutter, the switching arm 25 is again moved by the shutter, so that this arm sets the slide switch from its on-position to its second off-position, thus causing the motor circuit to be interrupted. In this further latched position of the shutter which is latched by the balls 23 and 24 and in which the dry-shaving shaving apparatus is ready for operation, the shaving-head frame 2 can then be removed from the basic apparatus 1 without being impeded by the shutter 3, for example for the purpose of cleaning or for replacing the shear foil.

If the shutter is slid out of said further latched position which is latched by the balls 23 and 24 in the opposite direction towards the shear foil 9, the shutter again reaches the first latched position which is latched by the balls 14 and 15, so that the switching arm 25 is moved again and the slide switch is set from its second off-position to its on-position, as a result of which the dry-shaving apparatus is again ready for operation. As the shutter is slid further towards the shear foil 9 the shutter leaves first latched position in which it is latched by the balls 14 and 15, again moving the switching arm 25 to set the slide switch to its first off-position, as a result of which the motor circuit is interrupted again. As the shutter is moved still further towards the shear foil 9 the switching arm 25 will reach its end position which is limited by the slot 26 in the apparatus housing 11 and beyond which it can no longer be moved by the shutter, as a result of which the switching arm 25 becomes disengaged from the recess 27 in the gripping element 10 of the shutter and the coupling between the switching arm 25 and the shutter is interrupted, so that the shutter alone can be moved further until it completely covers the shear foil 9.

Figure 10:
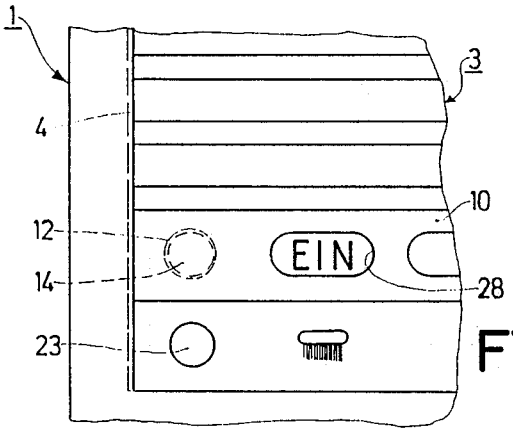
FIG. 10 shows a part of a dry-shaving apparatus as shown in FIG. 7 with a shutter having a viewing window, the shutter being in the same position as shown in FIG. 8
Figure 11:
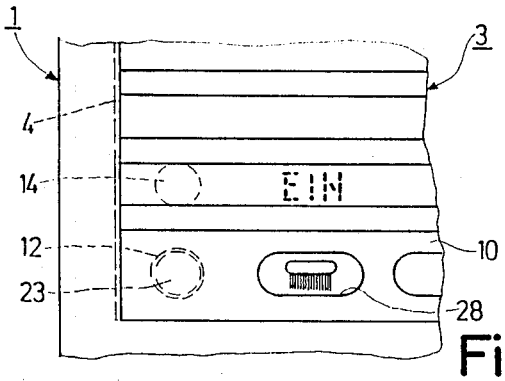
FIG. 11 shows the same part as shown in FIG. 10 of a dry-shaving apparatus as shown in FIG. 7, the shutter being in the same position as shown in FIG. 9.

In order to enable the two latched positions of the shutter 3 to be identified clearly by the user of the dry-shaving apparatus, it is found to be advantageous if the shutter is provided with a viewing window through which markings for these two shutter positions on the basic apparatus 1 are visible. As can be seen in FIGS. 10 and 11, such a viewing window 28 is provided, for example in the gripping element 10 of the shutter. In the first latched position of the shutter, in which position the shear foil 9 is exposed by the shutter 3 to allow shaving and the motor circuit is closed by means of the shutter, for example the indication "EIN" ("ON") is visible through the window 28, as shown in FIG. 10, to indicate that the dry-shaving apparatus is ready for shaving. In the further latched position of the shutter, in which position the shear foil 9 and the shaving head 2 are exposed by the shutter 3 and the motor circuit is interrupted by means of the shutter, for example the symbol of a brush is visible, as shown in FIG. 11, to indicate that the shaving-head frame 2 can be removed from the basic apparatus, for example for the purpose of cleaning, without being hindered by the shutter. For example, the basic apparatus 1 may be provided with a further symbol which is visible through the viewing window 28 if the shutter 3 is in the position in which it completely covers and protects the shear foil 9.

Obviously, several modifications of the embodiments described above are possible within the scope of the invention. This applies in particular to the construction of the latching means for the two positions of the shutter and the way in which the motor circuit of the dry-shaving apparatus is closed and interrupted.

What is claimed is:

1. A dry-shaving apparatus comprising a shaving-head frame which is detachably secured to a basic apparatus and which carries a shear foil, a slidable shutter for optionally covering or exposing the shear foil of the dry-shaving apparatus which shutter is laterally guided by guide means in the shaving apparatus and can be slid from the shear foil completely onto the basic apparatus and locked by first and second latch means, respectively, into a first latched position in which the circuit of the motor for driving the dry-shaving apparatus is closed when said shutter is slid away from the shear foil to expose said shear foil to allow shaving, and into a further latched position in which the shear foil and the shaving head frame are exposed by the shutter and the motor circuit is interrupted by means of the shutter.

2. A dry-shaving apparatus as claimed in claim 1, wherein the further latched position of the shutter, in which position the shear foil and the shaving head frame are exposed by the shutter and the motor circuit is interrupted by means of the shutter, is situated before first latched position of the shutter in which the shear foil is exposed by the shutter to allow shaving and the motor circuit is closed by means of the shutter.

3. A dry-shaving apparatus comprising a shaving-head frame which is detachably secured to a basic apparatus and which carries a shear foil, a slidable shutter for optionally covering or exposing the shear foil of the dry-shaving apparatus which shutter is laterally guided by guide means in the shaving apparatus and can be slid from the shear foil completely onto the basic apparatus and locked by first and second latch means, respectively, into a first latched position in which the circuit of the motor for driving the dry-shaving apparatus is closed when said shutter is slid away from the shear foil to expose said shear foil to allow shaving, and into a further latched position in which the shear foil and the shaving head frame are exposed by the shutter and the motor circuit is interrupted by means of the shutter, wherein the further latched position of the shutter is situated before the first latched position of the shutter, said shutter being provided with a viewing window through which markings indicating the two latched shutter positions and provided on the basic apparatus are visible.

4. A dry-shaving apparatus comprising a shaving-head frame which is detachably secured to a basic apparatus and which carries a shear foil, a slidable shutter for optionally covering or exposing the shear foil of the dry-shaving apparatus which shutter is laterally guided by guide means in the shaving apparatus and can be slid from the shear foil completely onto the basic apparatus and locked by first and second latch means, respectively, into a first latched position in which the circuit of the motor for driving the dry-shaving apparatus is closed when said shutter is slid away from the shear foil to expose said shear foil to allow shaving, and into a further latched position in which the shear foil and the shaving head frame are exposed by the shutter and the motor circuit is interrupted by means of the shutter; said shutter being provided with a viewing window through which markings indicating the two latched shutter positions and provided on the basic apparatus are visible.

5. A dry-shaving apparatus comprising a shaving-head frame which is detachably secured to a basic apparatus and which carries a shear foil, a slidable shutter for optionally covering or exposing the shear foil of the dry-shaving apparatus which shutter is laterally guided by guide means in the shaving apparatus and can be slid from the shear foil completely onto the basic apparatus and locked by first and second latch means, respectively, into a first latched position in which the circuit of the motor for driving the dry-shaving apparatus is closed when said shutter is slid away from the shear foil to expose said shear foil to allow shaving, and into a further latched position in which the shear foil and the shaving head frame are exposed by the shutter and the motor circuit is interrupted by means of the shutter, wherein said shutter comprises a gripping element at its end which is remote from the shear foil and which is adapted to latch the shutter and close the motor circuit.

6. A dry shaving apparatus as claimed in claim 5 wherein said gripping element comprises two spaced apart spherical recesses which are adapted to cooperate with balls projecting from the housing.

7. A dry shaving apparatus as claimed in claim 6 wherein said balls are mounted in the housing in a cage closed by a cap, the balls being urged by a spring to project from the housing to engage in recesses in the gripping element to latch the shutter.

8. A dry shaving apparatus as claimed in claim 6 wherein the two positions of the shutter are latched by means of balls which cooperate with spherical recesses in the gripping element.

* * * * *